US005560616A

United States Patent [19]

Van Hessen

[11] Patent Number: 5,560,616

[45] Date of Patent: Oct. 1, 1996

[54] GAME USING STACKED MARBLES

[76] Inventor: John Van Hessen, 332 W. Stone St., Kankakee, Ill. 60901

[21] Appl. No.: 434,571

[22] Filed: May 4, 1995

[51] Int. Cl.[6] ..... A63F 9/00

[52] U.S. Cl. ..... 273/450

[58] Field of Search ..... 273/450, 122, 273/123, 125; 446/118

[56] References Cited

U.S. PATENT DOCUMENTS

| | | | |
|---|---|---|---|
| 70,469 | 11/1867 | Raymond | 273/123 R |
| 644,209 | 2/1900 | Murphy | 273/450 X |
| 970,257 | 9/1910 | McDonald et al. | 273/123 R |
| 1,725,911 | 8/1929 | Graham | 446/118 |
| 2,005,660 | 6/1935 | Maxwell | 273/123 R |
| 2,562,822 | 7/1951 | Sanger | 273/123 R X |
| 2,581,644 | 1/1952 | Frick | 273/450 |
| 3,136,548 | 6/1964 | Engle | 273/123 R |
| 4,066,263 | 1/1978 | Balas et al. | 273/123 R X |
| 5,072,936 | 12/1991 | Warehime | 273/450 |

FOREIGN PATENT DOCUMENTS

| | | | |
|---|---|---|---|
| 2133991 | 8/1984 | United Kingdom | 273/123 R |

OTHER PUBLICATIONS

Ideal 1976 Catalogue, Oct. 1976 p. 65, Breaking Point Game.

*Primary Examiner*—Paul E. Shapiro
*Attorney, Agent, or Firm*—Steven N. Fox, Esq.

[57] ABSTRACT

A game for use with more than one marbles. The game comprises a housing having first and second sides, a bottom surface and a return area. The bottom surface is sloped such that when the marbles are placed upon the bottom surface the marbles tend under the force of gravity to roll to the return area. The device also comprises a support member disposed above the bottom surface having a plurality of indentations to support one of the marbles. The device further comprises a casing connected to said housing to substantially enclose the same and a first handle member extending through the casing. The handle member comprises a first end which may be grasped by the person and a second end which may be used to grasp the marbles. The handle member being movable along the casing so that the marbles may be picked up from the return area and placed upon the support member.

7 Claims, 2 Drawing Sheets

GAME USING STACKED MARBLES

FIELD OF THE INVENTION

The present invention relates generally to games. More particularly, the present invention relates to a game using stacked marbles.

BACKGROUND OF THE INVENTION

Marbles have been used in connection with games for many years. For example, U.S. Pat. No. 5,072,936 discloses a game wherein a player may stack magnetically charged marbles. The device of this game comprises a stacking base 4 having a recessed portion 7 to receive the marbles. Each of the marbles 1 are magnetically charged such that they attract to each other. The marbles may be continually stacked upon each other until the stack becomes unstable and falls. Once the stack falls, the player must pick-up the marbles with their hands and begin the game again.

Games of the type disclosed by U.S. Pat. No. 5,072,396 have several disadvantages which make their use difficult. First, the marbles must be picked up by the person's hand. Second, after the stack of marbles fall, the individual marbles may roll away from the player and the game thereby causing difficulty in playing the game and/or the loss of marbles. Third, each of the marbles is magnetically charged and as such after extended use the magnetic charges will dissipate and the player will be unable to stack the marbles. All of the above disadvantages tend to make the player lose interest in the game over extended use.

SUMMARY OF THE PRESENT INVENTION

One object of the present invention was to develop a game involving the stacking of marbles which would prevent the marbles from escaping. Another object of the present invention was to develop a game involving the stacking of marbles which would maintain the player's interest.

The above objects are realized by the game of the present invention which generally comprises a housing enclosed by a transparent casing. The housing is formed with a sloped bottom surface and a return area. The housing is further formed with a support member disposed above the sloped bottom surface. The support member is formed with a plurality of indentations to support one of the marbles. A marble falling off of the support member falls onto the bottom surface where because of the sloped surface the marbles tend under the force of gravity to collect in the return area.

The present invention further comprises a first handle member extending through the casing and into the housing. The handle member may be used by the player to grasp the marbles in the return area and to place the same upon the support member.

In operation, a player would use the handle member to grasp a marble within the return area and move the same to an unoccupied indentation on the support member or on stop of an already existing layer of marbles. If the marbles are dropped by the person or otherwise fall off of the stack, the marbles will come in contact with the sloped bottom surface and will be transported under gravity to the return area.

The game of the present invention offers significant advantages over conventional marble stacking games. With the present invention, a player may use a variety of skills and talents to stack marbles. The player uses a first skill to grasp the marbles with the handle member and a second skill to choose where to place the marbles so as to increase the height of the stack. Further, should one or more of the marbles fall off the stack, the marbles are diverted to the return area thereby avoiding the possibility of loosing marbles and making it more enjoyable for the person to play the game.

BRIEF DESCRIPTION OF THE DRAWINGS

The following detailed description of the invention will be more fully understood with reference to the accompanying drawings in which.

DETAILED DESCRIPTION OF THE PREFERRED EMBODIMENTS

Figure 1:
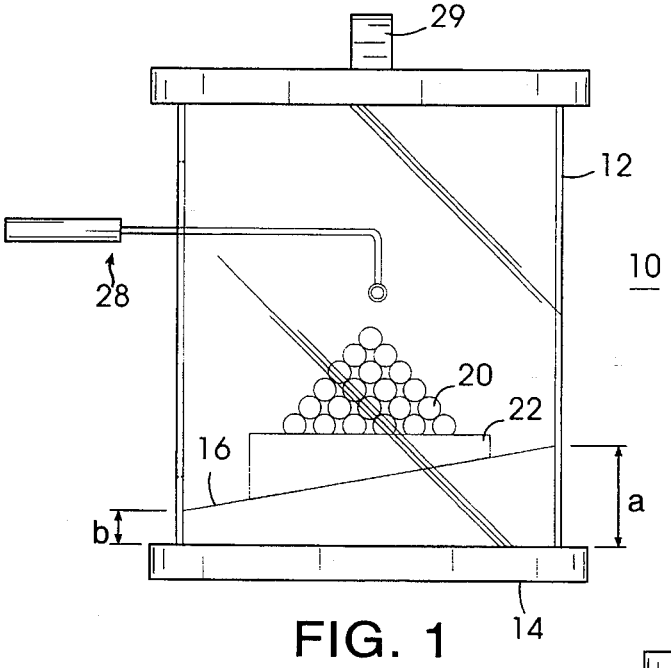
FIG. 1 is a front view of the present invention.
Figure 2:
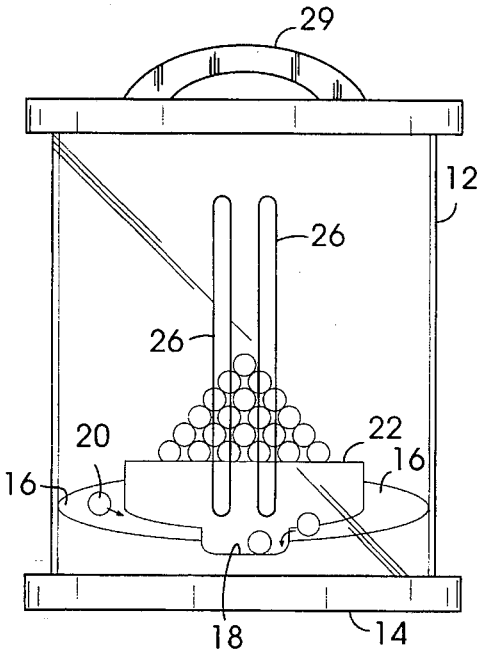
FIG. 2 is a side view of the present invention.
Figure 3:
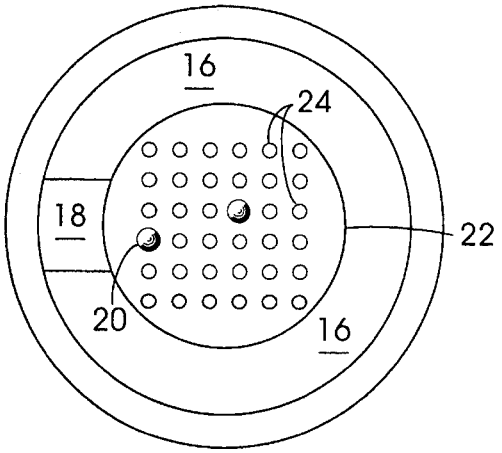
FIG. 3 is a section view taken along line A—A of FIG. 1.
Figure 4:
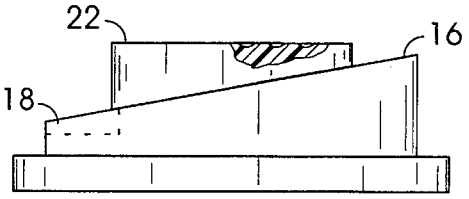
FIG. 4 is a side view of the housing of the present invention.

Referring to FIG. 1, wherein the device 10 of the present invention is shown generally comprising a cylindrical enclosure or casing member 12 mounted by conventional means to a cylindrical base or housing member 14.

The housing 14 comprises a sloped bottom surface 16 which slopes from a height of a along one side of the housing 14 to a height b along the opposite side of the housing 14. The housing 14 further comprises a recessed portion or return area 18 which is formed as part of the housing 14 and sloped bottom surface 16. In the preferred embodiment, the shape of the sloped bottom surface 16 is such that any marble 20 falling onto the sloped bottom surface 16 will roll under the force of gravity to the return area 18.

The housing 14 further comprises a marble stacking or support member 22. The support member 22 comprises a plurality of spaced indentations or openings 24 sized to removably receive any one of the marbles 20. In the preferred embodiment, if the diameter of the marbles 20 is about 0.620 inches, then the preferred diameter of openings 24 should be about 0.625 inch and drilled to a depth to accommodate marble 20. Additionally, the openings 24 should be equidistantly spaced at intervals of about 0.625 inches upon support member 22.

If the marble diameter is 0.620 inches and if the spacing of openings 24 were at 0.625 inches, then a clearance of 0.005 inches would exist between marbles. This would be for average play. If the clearance was reduced to 0.621 inches, play would be more difficult because you would only have a 0.001 clearance between marbles. In essence, the larger the hole spacings to the size of the marble, the easier the game is to play. If the marbles were 0.620 inches and spacings were 0.620 inches, the game would be very challenging to play.

Figure 5:
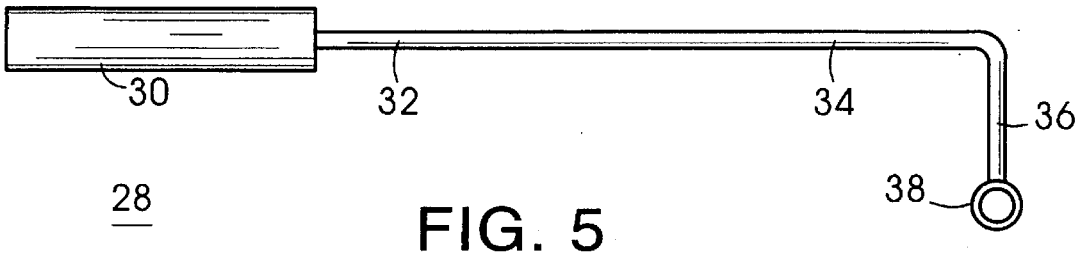
FIG. 5 is a plan view of the handle member.

The casing 12 is generally made from a plastic material and is transparent to allow the player to view the housing 14 to play the game. The casing 12 comprises a pair of slotted openings 26 located above the return area 18. The slotted openings 26 span a substantial portion of the height of the casing 12 and are adapted to allow a handle member 28 in FIG. 5 (to be described) to be moved therein to allow a player to grasp a marble 20 located in the return area 18 and place the same upon the support member 22. The casing 12 also comprises a carrying handle 29 disposed at the upper portion of the casing 12. The carrying handle 29 is adapted to allow the player to transport the device 10.

Figure 6:
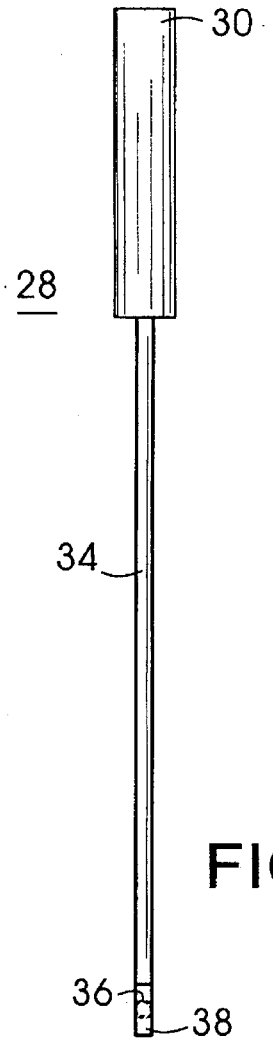
FIG. 6 is a side view of the handle member of FIG. 5.

The handle members 28 (FIGS. 5 and 6) are generally adapted to allow a player to pick-up a marble 20 within the housing 14 and to place the marbles upon the support member 22 or upon the top of an already existing layer of marbles 20. Each of the handle members 28 may take a number of forms and shapes so long as they are suitable for picking up a marble 20. Moreover, although two handle members 28 are shown, the device 10 could easily employ only a single handle to pick-up the marbles 20. In the preferred embodiment, each of the handle members 28 comprises a handle portion 30 connected to a first end 32 of an extension portion 34 which extends through the slots 26 to housing 14. A second end 36 of the extension portion 34 is provided with a hook or cup shaped portion 38 which may be manipulated to pick-up a marble 20.

In operation, a person would use the handle members 28 to grasp a marble 20 within the return area 18 and move the same to an unoccupied opening 24 on the support member 22 or on top of an already existing layer of marbles 20. If the marble 20 is dropped by the person, the marble 20 will come in contact with the sloped bottom surface 16 and will tend to roll under gravity to the return area 18. The above process is continued until the stack of marbles 20 becomes higher and higher. Should one or more of the marbles 20 fall off the stack, the marbles 20 will be diverted to the return area 18 wherein they can be grasped and re-stacked upon the support platform 22.

The foregoing description is intended primarily for purposes of illustration. This invention may be embodied in other forms or carried out in other ways without departing from the spirit or scope of the invention. Modifications and variations still falling within the spirit or the scope of the invention will be readily apparent to those of skill in the art.

What is claimed is:

1. A device for use with marbles, the device comprises:

(a) a housing having first and second sides, a bottom surface and a return area, said bottom surface being sloped such that when the marbles are placed upon said bottom surface the marbles tend under the force of gravity to roll to said return area;

(b) a support member disposed above said bottom surface, said support member having a plurality of indentations to support one of the marbles, said indentations being spaced to allow stacking of the marbles;

(c) a casing connected to said housing to substantially enclose said housing; and (d) a first handle member extending through said casing and into said housing, said first handle member comprises a first end which may be grasped by the person and a second end which may be used to grasp the marbles, said first handle member being movable along said casing so that the marbles may be picked up from said return area and placed upon said support member.

2. The device of claim 1 further comprising a second handle member extending through said casing and into said housing, said second handle member comprises a first end which may be grasped by the person and a second end which may be used to grasp the marbles, said second handle member being movable along said casing so that the marbles may be picked up from said return area and placed upon said support member.

3. The device of claim 1, wherein said indentations are equidistantly spaced and spaced such that the marbles may be stacked upon each other.

4. The device of claim 3, wherein said return area, said bottom surface and said support platform are formed integrally to each other.

5. The device of claim 4, wherein said casing is transparent.

6. The device of claim 5, wherein said casing is of cylindrical shape.

7. The device of claim 6, wherein said sloped bottom surface is of cylindrical shape.

* * * * *